US005511377A

United States Patent [19]

Kotwicki

[11] Patent Number: 5,511,377

[45] Date of Patent: Apr. 30, 1996

[54] ENGINE AIR/FUEL RATIO CONTROL RESPONSIVE TO STEREO EGO SENSORS

[75] Inventor: Allan J. Kotwicki, Sterling Heights, Mich.

[73] Assignee: Ford Motor Company, Dearborn, Mich.

[21] Appl. No.: 283,434

[22] Filed: Aug. 1, 1994

[51] Int. Cl.[6] ..... F01N 3/20

[52] U.S. Cl. ..... 60/274; 60/276; 60/285; 123/692; 123/696

[58] Field of Search ..... 60/276, 285, 274; 123/692, 696

[56] References Cited

U.S. PATENT DOCUMENTS

| | | | |
|---|---|---|---|
| 4,703,735 | 11/1987 | Minamitani | 123/692 |
| 4,766,870 | 8/1988 | Nakajima | 123/692 |
| 4,984,551 | 1/1991 | Moser | 123/692 |
| 5,074,113 | 12/1991 | Matsuoka | 60/276 |
| 5,213,088 | 5/1993 | Harada | 123/692 |
| 5,341,788 | 8/1994 | Uchida | 123/692 |

*Primary Examiner*—Douglas Hart
*Attorney, Agent, or Firm*—Allan J. Lippa; Roger L. May

[57] ABSTRACT

An air/fuel control system (8) and method for an engine (28) having two engine banks coupled to a single catalytic converter (50). First and second exhaust gas oxygen sensors (44, 55) are coupled to respective first and second exhaust manifolds (56, 57). A feedback signal is generated by a PI controller responsive to an average (104–120) of the first and second sensor outputs (44, 45). An adjustment signal is generated (440–448) by another PI controller responsive to a difference between the first and second sensor outputs (44, 45). Fuel delivered to the first engine bank (**300*a*–306*a*) is adjusted by a first modified feedback signal generated by adding the adjustment term to the feedback signal (450–454). And, fuel delivered to the second engine bank (300*b*–306*b*) is adjusted by a second modified feedback signal generated by adding the adjustment term to the feedback signal (460–462**).

17 Claims, 5 Drawing Sheets t
1
0
-1
1.05
.95
EGOA
EGOB
EGOA + EGOB
2
EGOA -
EGOB
FV

ENGINE AIR/FUEL RATIO CONTROL RESPONSIVE TO STEREO EGO SENSORS

FIELD OF THE INVENTION

The invention relates to air/fuel control systems responsive to an exhaust gas oxygen sensor coupled to each cylinder bank of an engine.

BACKGROUND OF THE INVENTION

It is well known to control the air/fuel ratio of an engine having two cylinder banks in response to an exhaust gas oxygen sensor coupled to each of the banks. U.S. Pat. No. 5,074,113 discloses such an air/fuel control system wherein the exhaust manifold of each engine bank is coupled to a single catalytic converter via y-pipe.

The inventors herein have recognized a problem with the above approaches having a single catalytic converter coupled to each engine bank. When one back runs lean of stoichiometry, while the other bank runs rich of stoichiometry, less than 100% converter efficiency is achieved.

SUMMARY OF THE INVENTION

An object of the invention herein is to provide an engine air/fuel control system responsive to first and second feedback variables each derived from an exhaust gas oxygen sensor coupled to an engine bank wherein the feedback variables are in phase of one another.

The above object is achieved, and problems of prior approaches overcome, by providing both a control system and method for controlling an engine air/fuel ratio in response to first and second exhaust gas oxygen sensors each coupled to respective first and second engine banks. In one particular aspect of the invention, the method comprises the steps of: deriving a feedback signal from an average of output signals from the first and second sensors; generating a first modified feedback signal by adding an adjustment signal derived from a difference between the feedback signal and the output signals from the first and second sensors; generating a second modified feedback signal by subtracting the adjustment signal from the feedback signal; and trimming fuel delivered to the first bank in response to the first modified feedback signal and trimming fuel delivered to the second bank in response to the second modified feedback signal.

An advantage of the above aspect of the invention is that the output from first and second sensors are forced to operate in phase of one another thereby achieving optimal catalytic converter efficiency.

In another aspect of the invention the control system comprises: first and second exhaust gas oxygen sensors each communicating with the first and second engine banks, respectively; feedback means for deriving a feedback signal by integrating an average of output signals from the first and second sensors; difference means for providing an adjustment signal by integrating a difference between the output signals from the first and second sensors; a controller adding the adjustment signal to the feedback signal to generate a first modified feedback signal and subtracting the adjustment signal from the feedback signal to generate a second modified feedback signal; and trimming means for trimming fuel delivered to the first bank in response to the first modified feedback signal and trimming fuel delivered to the second bank in response to the second modified feedback signal.

By driving the difference between the two sensor outputs towards zero, an advantage is achieved of forcing the two sensor outputs to be in phase of one another thereby achieving optimal converter efficiency.

BRIEF DESCRIPTION OF THE DRAWINGS

The object and advantages of the invention described above will be more clearly understood by reading an example of an embodiment in which the invention is used to advantage with reference to the attached drawings wherein.

DESCRIPTION OF AN EMBODIMENT

Figure 1:
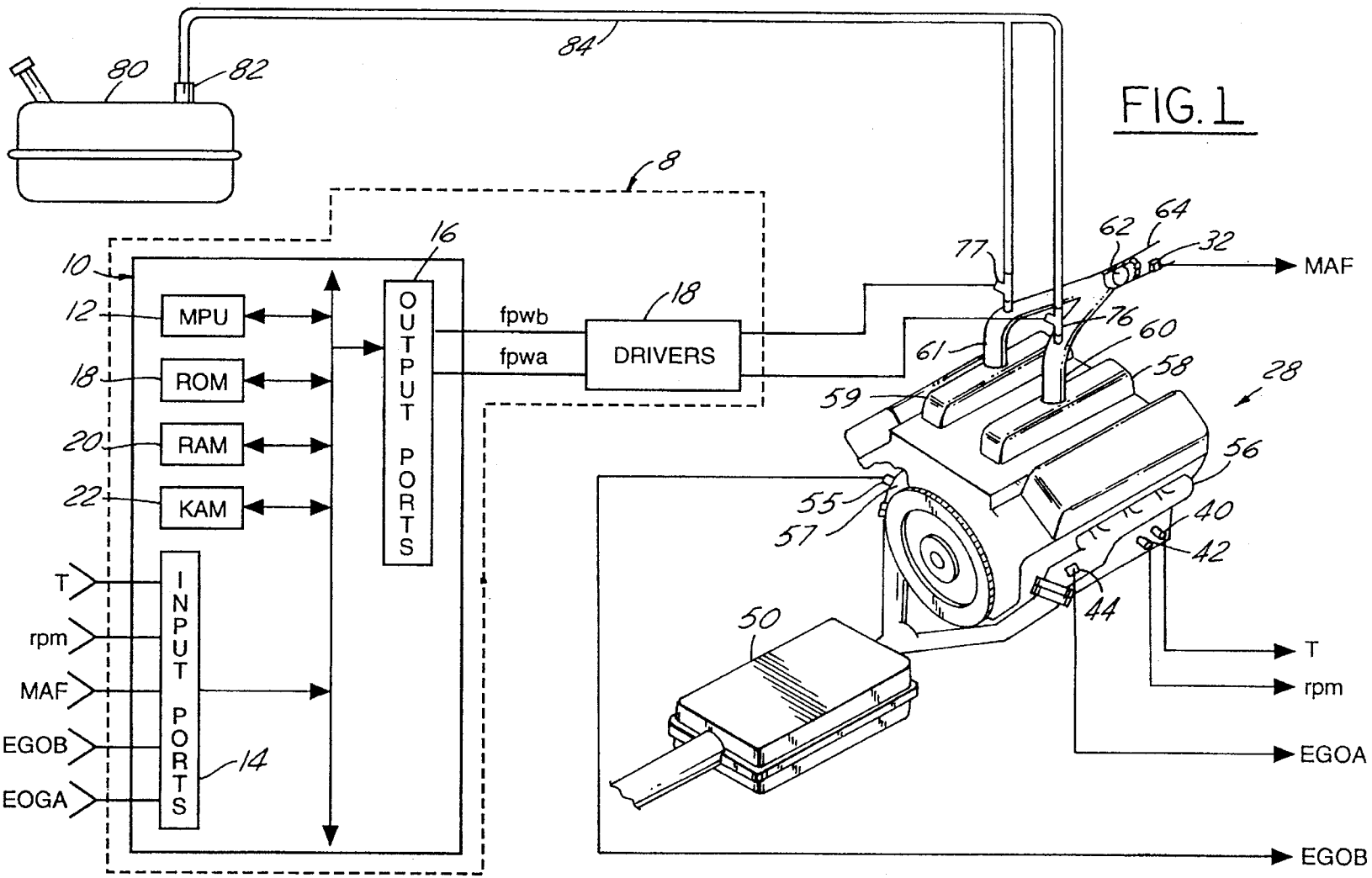
FIG. 1 is a block diagram of an embodiment wherein the invention is used to advantage.

Controller 8 is shown having conventional microcomputer 10 including: microprocessor unit 12; input ports 14; output ports 16; read only memory 18, for storing the controlled program; random access memory 20, for temporary data storage which may also be used for counters or timers; keep alive memory 22, for storing learned values; and a conventional data buss. Outputs of microcomputer 10 are shown coupled to conventional electronic drivers 18.

Various signals from sensors coupled to engine 28 are shown coupled to controller including: measurement of inducted mass air flow (MAF) from air flow sensor 32, engine coolant aperture (T) from temperature sensor 40; and indication of engine speed (RPM) from tachometer 42.

Output signal EGOA is provided from conventional exhaust gas oxygen sensor 44 coupled to right-hand exhaust manifold 56 which, in this particular example, is coupled to the right-hand cylinder bank of a V-8 engine. Similarly, output signal EGOB is shown provided by conventional exhaust gas oxygen sensor 55 coupled to left-hand exhaust manifold 57.

Intake manifold 58 and intake manifold 59 are respectively coupled to the right-hand cylinder bank and left-hand cylinder bank of engine 28 and are also shown communicating with respective throttle body 60 and throttle body 61. Each throttle body in turn is shown connected to single air intake 64. Throttle plate 62 and mass air flow sensor 32 are shown coupled to air intake 64.

Continuing with FIG. 1, conventional electronic fuel injectors 76 and 77 are shown coupled to respective throttle body 60 and throttle body 61. Fuel injectors 76 delivers fuel in proportion to the pulse width of signal fpwa from controller 8 via one of the conventional electronic drivers 18. Similarly, fuel injector 77 delivers fuel in proportion to the pulse width of signal fpwb from controller 8 via one of the electronic drivers 18. Fuel is delivered to fuel injectors 76 and 77 by a conventional fuel system including fuel tank 80, fuel pump 82, and fuel rail 84.

Those skilled in the art will recognize that although a central fuel injected (CFI) system is shown for each cylinder bank, the invention claimed herein is also applicable to other fuel delivery systems such as those having a separate fuel injector coupled to each cylinder and carbureted systems. It is also recognized that the invention is applicable to other engine and exhaust gas oxygen sensors such as a separate sensor coupled to a plurality of combustion sensors in an in-line engine. Further, the invention is applicable to sensors other than two-state sensors such as proportional sensors.

Figure 2:
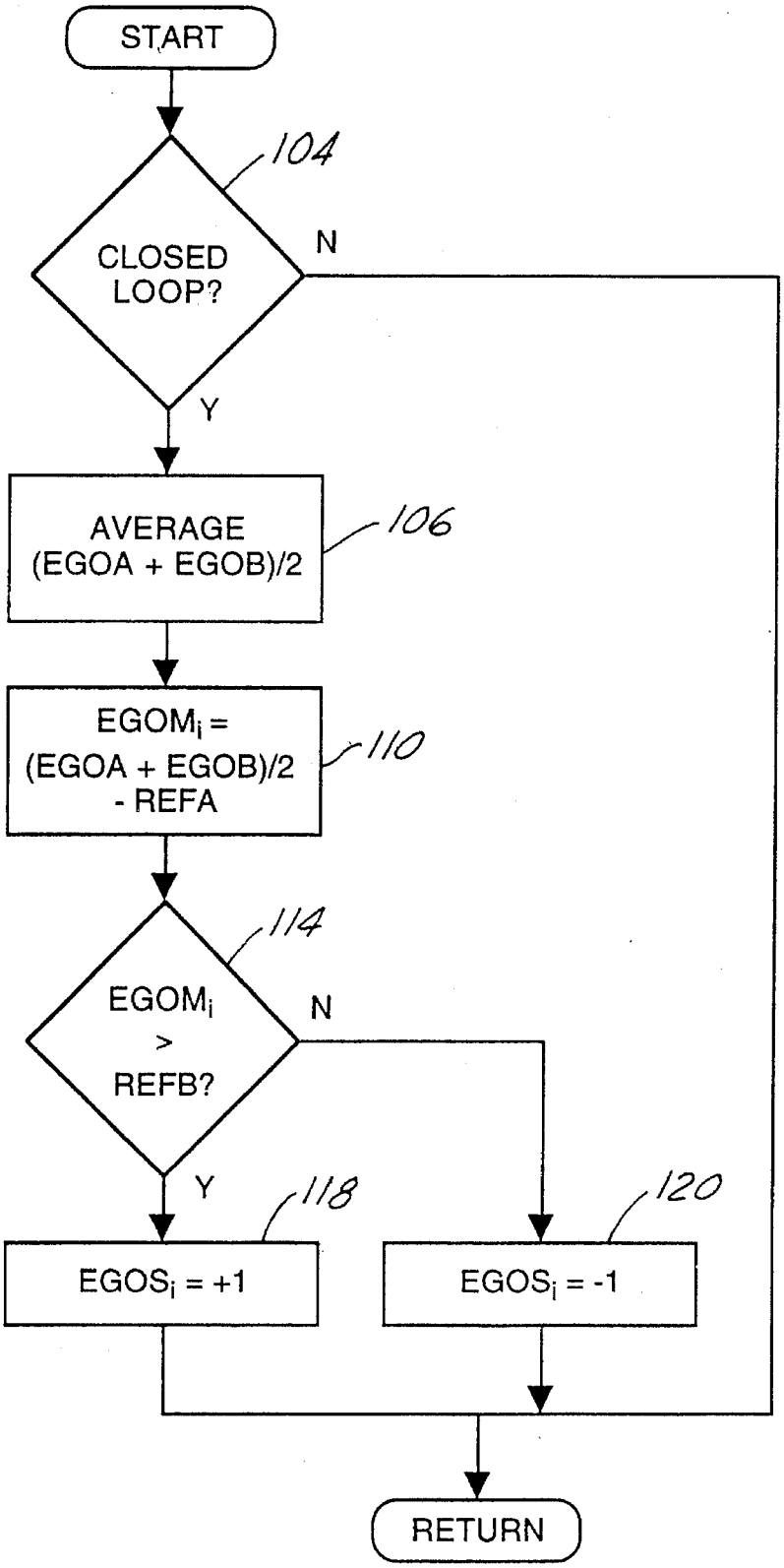
FIGS. 2, 3A–3B, 4–5, and 6A–6B are high level flow charts of various operations performed by a portion of the embodiment shown in FIG. 1.

Referring now to FIG. 2, a flowchart of a routine performed by controller 8 to generate two-state signal $EGOS_i$ each background loop or sample period (i) is now described. The routine is entered after closed-loop air/fuel control is commenced (step 104) in response to preselected operating conditions such as engine temperature. When closed-loop control commences, signal EGOA and signal EGOB from respective exhaust gas oxygen sensors 44 and 55 are sampled and averaged (step 106). Each sample period (i), signal $EGOM_i$ is generated by subtracting reference value REFA from the averaged sensor signals (step 110). When signal $EGOM_i$ is greater than reference value REFB (step 114), signal $EGOS_i$ is set equal to a predetermined positive value such as one volt (step 118). An indication is thereby provided that the average sensor output is rich of a desired air/fuel ratio such as stoichiometry. On the other hand, when $EGOM_i$ is less than reference value REFB as shown in step 114, signal $EGOS_i$ is set equal to a negative value such as minus one volt. An indication is thereby provided that the averaged sensor output is lean of a desired air/fuel ratio such as stoichiometry.

Figures 3A, 4:
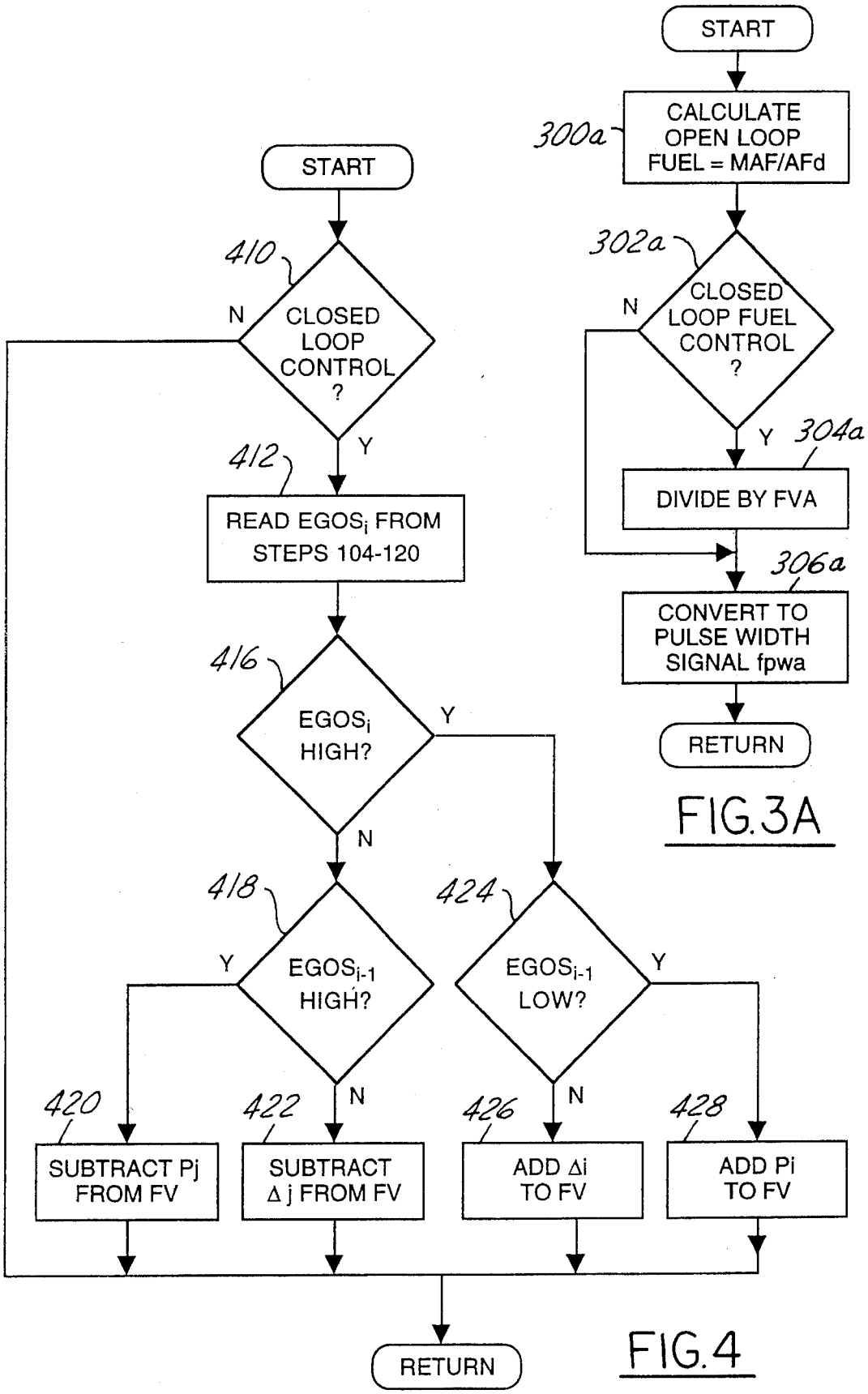
Figure 3B:
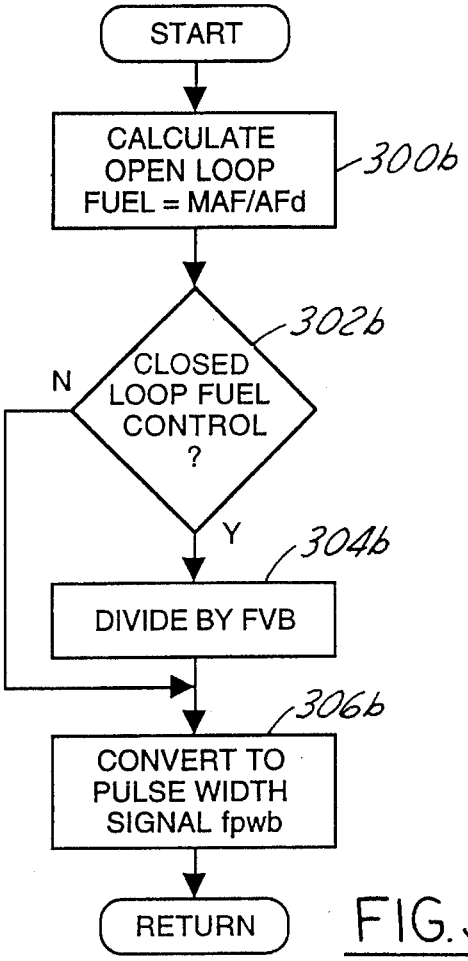

A flowchart of the liquid fuel delivery routine executed by controller 8 for controlling engine 28 is now described beginning with reference to the flowcharts shown in FIGS. 3A and 3B. FIG. 3A describes fuel delivery to the right engine bank of engine 28 and FIG. 3B describes fuel delivery for the left bank of engine 28.

In FIG. 3A, an open-loop calculation of desired liquid fuel is shown calculated in step 300*a*. More specifically, the measurement of inducted mass airflow (MAF) from sensor 32 is divided by desired air/fuel ratio AFd which in this particular example is the stoichiometric air/fuel ratio. After determination is made that closed-loop or feedback control is desired (step 302*a*), the open-loop fuel calculation is trimmed by fuel feedback variable FVA to generate the desired fuel signal during step 304*a*. This desired fuel signal is converted into fuel pulse width signal fpwa for actuating fuel injector 76 (FIG. 1) coupled to the right-hand engine bank.

In a similar matter, fuel pulse width fpwb is generated in FIG. 3B wherein like numerals refer to like steps shown in FIG. 3A. In the routine shown in FIG. 3B, the open-loop fuel calculation is divided by feedback signal FVB to generate fuel pulse width signal fpwb for the left-hand engine bank of engine 28.

In general, feedback signal FVA and feedback signal FVB are each generated from feedback signal FV as described in greater detail later herein with particular reference to FIGS. 6A and 6B. The routine for generating feedback signal FV is now described with reference to FIG. 4.

After closed-loop fuel control is commenced (step 410), signal $EGOS_i$ is read during sample time (i) from the routine previously described with respect to steps 104–120 shown in FIG. 2. When signal $EGOS_i$ is low (step 416), but was high during the previous sample time or background loop (i −1) of controller 8 (step 418), preselected proportional term Pj is subtracted from feedback variable FV (step 420). When signal $EGOS_i$ is low (step 416), and was also low during the previous sample time (step 418), preselected integral term Δj is subtracted from feedback variable FV (step 422).

Similarly, when signal $EGOS_i$ is high (step 416), and was also high during the previous sample period (step 424), integral term Δi is added to feedback variable FV (step 426). When signal $EGOS_i$ is high (step 416), but was low during the previous sample time (step 424), proportional term Pi is added to feedback variable FV (step 28).

As described in greater detail later herein with particular reference to FIGS. 6A and 6B, adjustment signal ADJ is subtracted from feedback signal FV to generate modified or adjusted feedback signal FVA for the right-hand cylinder bank of engine 28. Similarly, adjustment signal ADJ is added to feedback signal FV to generate modified or adjusted feedback signal FVB for adjusting the fuel delivered to the left cylinder bank of engine 28.

Figure 5:
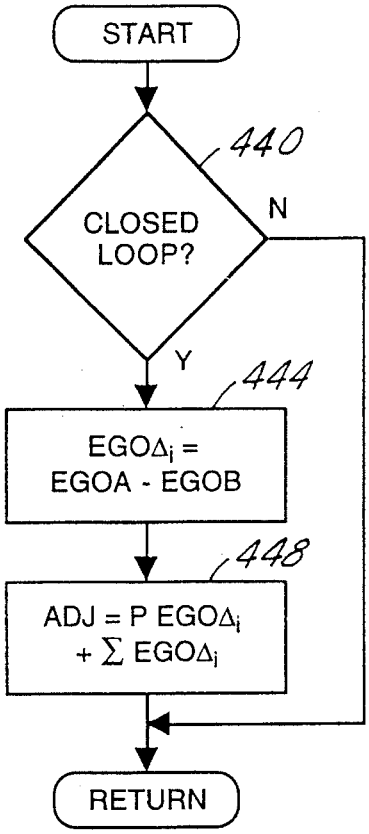

The routine for generating adjustment signal ADJ is now described with reference to the routine shown in FIG. 5. After closed-loop air/fuel control is determined in step 440, the difference between signal EGOA and signal EGOB from respective right exhaust manifold EGO sensor 44 and left exhaust manifold EGO sensor 55 is calculated to generate signal $EGO\Delta_i$ (step 444). Adjustment signal ADJ is then generated by processing signal $EGO\Delta_i$ in a proportional plus integral controller (step 448). More specifically, adjustment signal ADJ is generated by multiply proportional term "P" times signal $EGO\Delta_i$ each sample period (i). The resulting product is then added to the integral of signal $EGO\Delta_i$ each sample period (i).

Figure 6A:
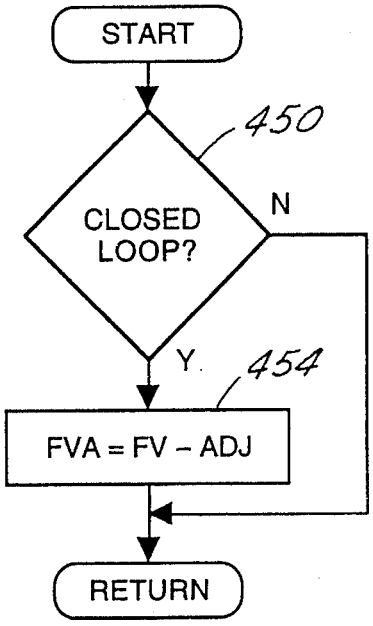
Figure 6B:
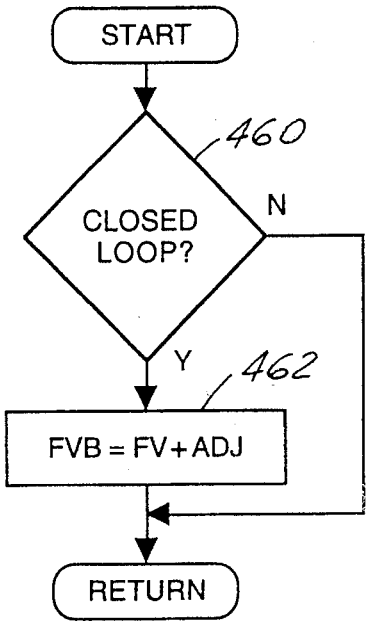

Feedback signal FVA for correcting the right cylinder bank of engine 28 is generated by the routine illustrated in FIG. 6A. More specifically, when controller 8 is in closed-loop fuel control (step 450), feedback signal FVA is generated by adding adjustment signal ADJ to feedback signal FV (step 554). Similarly, feedback signal FVB for the left cylinder bank of engine 28 is generated by the routine shown in FIG. 6B. When closed-loop air/fuel control is commenced (step 460), feedback signal FVB is generated by subtracting adjustment signal ADJ from feedback signal FV (step 462). As discussed previously herein with particular reference to FIGS. 3A, feedback signal FVA trims the open-loop fuel calculation to maintain the right cylinder bank of engine 28 at, on average, a desired air/fuel ratio during closed-loop fuel control. Similarly, as previously described with reference to FIG. 3B, during closed-loop fuel control, feedback signal FVB trims the open-loop fuel delivery calculation to maintain the left cylinder bank at a desired, average air/fuel ratio.

Figures 7A, 7B, 7C, 7D, 7E:
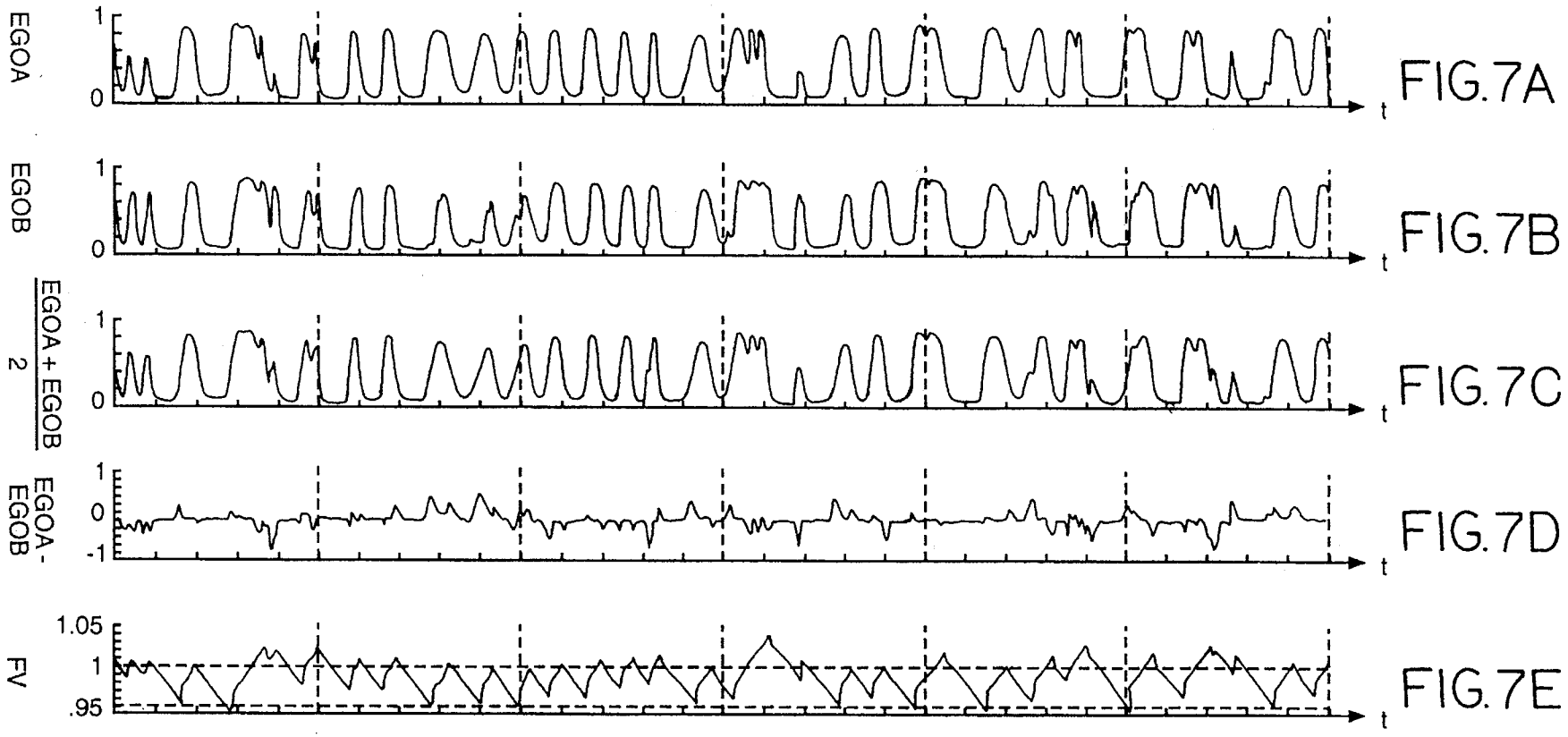
FIGS. 7A–7E illustrate various electrical signals emanating from the embodiment shown in FIG. 1 under hypothetical operating conditions described herein.

The advantageous effects of the particular example of operation described herein is shown graphically by the waveforms illustrated in FIGS. 7A–7E. Signal EGOA and signal EGOB are shown, respectively, in FIGS. 7A and 7B. It is seen that both signals are forced to be substantially in-phase with little difference between them, the small difference being shown in FIG. 7D. The average of signal EGOA and signal EGOB is shown in FIG. 7C and the resulting feedback signal FV is shown in FIG. 7E.

Although on example of an embodiment which practices the invention has been described herein, there are numerous other examples which could also be described. For example, the invention may be used to advantage with carbureted engines proportional exhaust gas oxygen sensors, and engines having an in-line configuration rather than a V-configuration. Further, other combinations of analog devices or discrete IC's may be used to advantage in place of the microcomputer shown. The invention is therefore to be defined only in accordance with the following claims.

What is claimed:

1. An air/fuel control method responsive to first and second exhaust gas oxygen sensors each coupled to respective first and second engine banks, comprising the steps of:

combining output signals from the first and second sensors and deriving, a first feedback signal from said combination;

generating a first modified feedback signal by modifying said first feedback signal in response to a difference between said output signals from the first and second sensors;

generating a second modified feedback signal by modifying said first feedback signal in response to said difference between said output signals from the first and second sensors; and adjusting fuel delivered to the first bank in response to said first modified feedback signal and adjusting fuel delivered to the second bank in response to said second modified feedback signal.

2. The method recited in claim 1 wherein said first generating step comprises a step of adding said difference to said first feedback signal to generate said first modified signal.

3. The method recited in claim 1 wherein said second generating step comprises a step of subtracting said difference to said first feedback signal to generate said second modified signal.

4. The method recited in claim 1 wherein said combining step averages said output signals from the first and second sensors.

5. The method recited in claim 1 wherein said combining step further comprises a step of averaging said output signals from the first and second sensors to generate an average signal and integrating said average signal to derive said first feedback signal.

6. The method recited in claim 1 wherein said combining step averages said output signals from the first and second sensors and integrates a difference between said average and a reference value to derive said first feedback signal.

7. The method recited in claim 1 further comprising a step of delivering fuel to the first bank in response to a measurement of air inducted into the first bank and a desired air/fuel ratio.

8. The method recited in claim 1 further comprising a step of delivering fuel to the second bank in response to a measurement of air inducted into the second bank and a desired air/fuel ratio.

9. The method recited in claim 1 further comprising a step of coupling exhaust gases from both the first bank and the second bank to a single catalytic converter.

10. The method recited in claim 1 further comprising a step of activating said combining step and said generating steps and said adjusting step when preselected engine operating conditions are at predetermined values.

11. An air/fuel control method for an engine having first and second engine banks each communicating with a respective first and second exhaust gas oxygen sensor, comprising the steps of:

deriving a feedback signal from an average of output signals from the first and second sensors;

generating a first modified feedback signal by adding an adjustment signal derived from a difference between said output signals from the first and second sensors to said feedback signal;

generating a second modified feedback signal by subtracting said adjustment signal from said feedback signal;and trimming fuel delivered to the first bank in response to said first modified feedback signal and trimming fuel delivered to the second bank in response to said second modified feedback signal.

12. The method recited in claim 11 wherein said deriving step averages said output signals from the first and second sensors and integrates a difference between said average and a reference value to derive said feedback signal.

13. The method recited in claim 11 further comprising a step of generating said adjustment signal by integrating said difference between said output signals from the first and second sensors.

14. An air/fuel control system for an engine having first and second engine banks, comprising:

first and second exhaust gas oxygen sensors each communicating with the first and second engine banks and each having first and second output signals, respectively;

feedback means for deriving a first feedback signal by averaging said first and second output from the first and second sensors to generate an average signal and integrating said average signal to generate said first feedback signal;

difference means for providing an adjustment signal by integrating a difference between said first and second output signals;

a controller adding said adjustment signal to said first feedback signal to generate a first modified feedback signal and subtracting said adjustment signal from said first feedback signal to generate a second modified feedback signal; and trimming means for trimming fuel delivered to the first bank in response to said first modified feedback signal and trimming fuel delivered to the second bank in response to said second modified feedback signal.

15. The system recited in claim 14 further comprising a catalytic converter coupled to the first and second engine banks.

16. The system recited in claim 14 wherein the engine has the first and second engine banks positioned in a V-configuration.

17. The system recited in claim 14 further comprising a first fuel injector coupled to the first engine bank and a second fuel injector coupled to the second engine bank.

* * * * *